United States Patent [19]

Ramella et al.

[11] Patent Number: 4,551,228

[45] Date of Patent: Nov. 5, 1985

[54] METHOD FOR IMPROVING REFORMER YIELD SELECTIVITY

[75] Inventors: Amilcare Ramella, Woodbury; Hsin-Ju Wang, Cherry Hill, both of N.J.

[73] Assignee: Mobil Oil Corporation, New York, N.Y.

[21] Appl. No.: 605,741

[22] Filed: May 1, 1984

[51] Int. Cl.[4] ..... C10G 35/06
[52] U.S. Cl. ..... 208/65
[58] Field of Search ..... 208/65

[56] References Cited

U.S. PATENT DOCUMENTS 4,174,271 11/1979 Mayes ..... 208/65
4,208,397 6/1980 Coates ..... 208/65

*Primary Examiner*—Curtis R. Davis
*Attorney, Agent, or Firm*—A. J. McKillop; M. G. Gilman; L. P. Hobbes

[57] ABSTRACT

Yield selectivity of a multibed catalytic reformer operating below design capacity is enhanced by adjusting inlet temperature of at least one catalyst bed to near-quenching conditions while adjusting the inlet temperature of at least one catalyst bed to favor yield selective reforming reactions. Significant increases in $C_5+$ yields are obtained without any modification of the reforming unit.

14 Claims, 4 Drawing Figures

METHOD FOR IMPROVING REFORMER YIELD SELECTIVITY

BACKGROUND OF THE INVENTION

1. Field of the Invention

This invention relates to a method for reforming a hydrocarbon feedstock such as naphtha. More particularly, the invention is concerned with a method for improving the yield selectivity of a multibed catalytic reformer operating below design capacity.

2. Discussion of the Prior Art

The term "reforming" is well known in the petroleum industry and refers to the treatment of gasoline or fractions thereof to improve their anti-knock characteristics. The reforming process involves many reactions not all of which are entirely understood or even known. The primary known reactions comprise controlled or selective aromatization and cracking, the former including dehydrogenation of naphthenic hydrocarbons to aromatics and the cyclization of straight chain or mildly branched chain aliphatic hydrocarbons of at least six carbon atoms to form aromatics. Other reactions occurring during reforming include isomerization, both of aliphatic hydrocarbons and of naphthenic hydrocarbons containing five and six ring carbon atoms, hydrogen transfer reactions, alkyl transfer reactions, and the like.

In the reforming process of naphthenic compounds, both cyclohexanes and cyclopentanes are converted to aromatic compounds to obtain high octane reformate. In reforming, the cyclohexanes can be converted to aromatics by a simple, clean dehydrogenation reaction, while the cyclopentanes have to be first isomerized and then dehydrogenated to yield aromatics. In comparison with cyclohexanes, reactions of cyclopentanes to aromatics are not only slower, but also lead to undesirable side reactions as for example, cracking to light gases, resulting in lower reformate yield and poorer process performance.

At times of decreased reformate demands, it is necessary to operate reformers below design capacities. However, even when operating below design throughput, the catalyst fills of the reforming units are at the same level found at design throughput. Thus, most units operating below design throughput are holding more catalyst than they require, and are therefore running at lower than optimum space velocity and reactor temperature.

SUMMARY OF THE INVENTION

The present invention relates to a method for reforming naphtha boiling range hydrocarbon charge stocks with platinum group metal-containing reforming catalysts. The reforming unit of the present invention employs a plurality of catalyst beds which are operated under conditions which favor the production of $C_5+$ products. The method of the present invention comprises operating at least one reactor near quenching conditions while operating at least one other reactor under yield-selective reforming conditions. Near-quenching conditions employed comprise near-quenching inlet temperatures while the yield-selective reforming conditions comprise yield-selective inlet temperatures. Operating a reformer according to the method of this invention can result in a $C_5+$ yield increase without any additional capital expenditure.

While not wishing to be bound by theory, it is believed that reforming kinetics and thermodynamics indicate $C_5+$ reformate yields for a given octane product should increase at higher reactor temperatures. Accordingly, it is believed that higher reformate yields can be obtained by running commercial reforming units which are operating at less than design levels by idling a reactor of the multibed reformer unit at lower than normal inlet temperatures. Operating at such temperatures raises the effective space velocity by virtually removing one reactor from service. This is a preferred alternative to removing catalyst from each reactor, an operation which is costly, time consuming and generally disruptive.

DESCRIPTION OF SPECIFIC EMBODIMENTS

Figure 1:
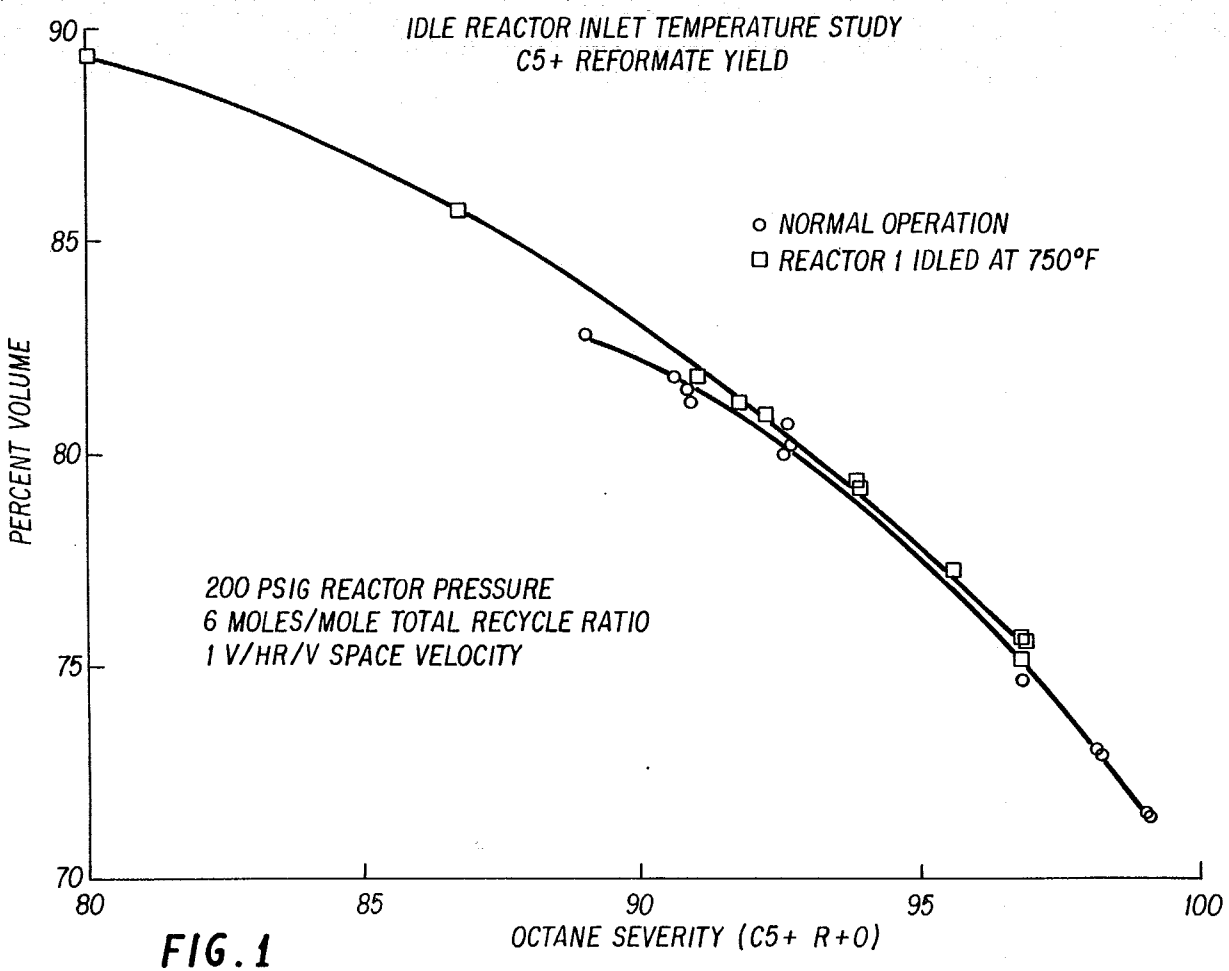
FIG. 1 depicts a comparison of the $C_5+$ reformate yield of a three reactor reforming operation wherein all three reactors are operated at reforming conditions with an operation wherein the first reactor is idled.

The present invention relates to a method for enhancing the $C_5+$ yield selectivity of a reforming process, where said reforming process utilizes a plurality of catalyst beds. In particular, the present invention enhances $C_5+$ hydrocarbon selectivity by an improved operating mode for the reformer. This improved mode involves operating only a portion of the available catalyst within the reformer at conditions conducive to better yields of desired $C_5+$ hydrocarbons. More particularly, the present invention comprises adjustment of the operating conditions within the various catalyst bed reactors. At least one catalyst bed reactor is idled, i.e., operated under near-quenching conditions while at least one other catalyst bed reactor is operated under reforming conditions which are yield-selective. The near-quenching conditions may include near-quenching reactor inlet temperatures. Generally, such lowered inlet temperatures result in an increase in effective space velocity. Yield-selective conditions, on the other hand, may comprise increased reactor inlet temperatures. Near-quenching conditions may be obtained by maintaining a reactor inlet at temperatures ranging from about 316° to 482° C. (600° to 900° F.) preferably about 343° to 454° (650° to 850° F.). Yield-selective reforming conditions may be achieved by operating a reactor at inlet temperatures of 454° to 549° C. (850° to 1020° F.), preferably about 482° to 527° C. (900° to 980° F.). As reaction conditions approach quenching, a vital cessation of the reforming reaction occurs, e.g., cessation of the naphthene-dehydrogenation reaction. Although it is generally known that it is highly desirable to avoid operating below the quench point in order to avoid undesired conversion by cracking, there is no suggestion in the prior art that operating slightly above quench conditions would result in improved yield selectivity in reformers operated below design capacity.

In effecting the reforming of hydrocarbons with platinum group metal-containing reforming catalysts, it is the usual practice of the operator or refiner to employ a plurality of catalyst beds comprising at least three beds of catalyst and separate reactors arranged in a series and provided with a means for heating the feed passed to each catalyst bed. In some arrangements, the first bed of catalyst will be a small volume of catalyst of lesser amount than that employed in the final reactor and usually the second catalyst bed will be equal to, or more than the volume of catalyst employed in the first reactor. The volume of catalyst employed in a third reactor, however, is about equal to the catalyst volume of the second reactor, or about equal to at least the sum of the catalyst volumes employed in the first two reactors.

In a particularly preferred embodiment of the present invention, the reforming unit comprises a first, second and third catalyst bed. The first catalyst bed may be maintained at near-quenching temperatures, i.e., slightly above quenching, while the second and third catalyst beds are maintained at yield-selective reforming temperatures. Alternatively, the second catalyst bed may be maintained at near-quenching temperatures while the first and third catalyst beds are maintained at yield-selective reforming temperatures. In those embodiments wherein the first catalyst bed is maintained at near-quenching conditions, the inlet temperature may range from about 316° to 427° C. (600° to 800° F.), preferably about 343° to 399° C. (650° to 750° F.). The second catalyst bed is maintained at an inlet temperature ranging from about 454° to 549° C. (850° to 1020° F.), and preferably about 482° to 527° C. (900° to 980° F.) while the third catalyst bed is maintained at an inlet temperature ranging from about 454° to 549° C. (850° to 1020° F.) preferably about 482° to 527° C. (900° to 980° F.). When the second catalyst bed is maintained at near quenching temperatures, the first catalyst bed is maintained at an inlet temperature of about 454° to 549° C. (850° to 1020° F.), preferably about 482° to 527° C. (900° to 980° F.). The second catalyst bed is maintained at an inlet temperature ranging from about 343° to 454° C. (650° to 850° F.), preferably about 371° to 427° C. (700° to 800° F.). The third catalyst bed is maintained at an inlet temperature ranging from about 454° to 549° C. (850° to 1020° F.), preferably about 482° to 527° C. (900° to 980° F.).

In another embodiment of the present invention, the third reactor of a three reactor reformer may be idled. When the third catalyst bed is maintained at near-quenching temperatures, the first catalyst bed is maintained at an inlet temperature of about 454° to 549° C. (850° to 1020° F.), preferably about 482° to 527° C. (900° to 980° F.). The second catalyst bed is maintained at an inlet temperature ranging from about 454° to 549° C. (850° to 1020° F.), preferably about 482° to 527° C. (900° to 980° F.). The third catalyst bed is maintained at an inlet temperature ranging from about 371° to 482° C. (700° to 900° F.), preferably about 399° to 454° C. (750° to 850° F.).

In the reforming reactor of the present method, the reactant stream comprising hydrogen and a suitable hydrocarbon charge, e.g., naphtha is sequentially contacted with the catalyst beds maintained under temperature, pressure, and space velocity conditions particularly selected for effecting dehydrogenation, hydrogenation, dehydrocyclization or isomerization of constituents comprising the naphtha boiling range charge. Product gases may be recycled. Suitable Total Recycle Ratios, (TRR) i.e., moles of recycle gas/moles of hydrocarbon charge, may range from about 5 to 12. The naphtha charge of gasoline boiling material to be upgraded may boil in the range of from about $C_5$ hydrocarbons up to about 204° or 216° C. (400° to 420° F.). More usually, however, the end boiling point of the charge will be in the range of about 193° C. (380° F.) and the initial boiling point will include $C_6$ hydrocarbons. The reforming temperatures employed are usually selected from within the range of 454° C. up to about 549° C. (850° up to about 1020° F.). The reforming pressure may be selected over a relatively wide range from as low as about 50 psig up to about 1,000 psig. However, it is preferred to effect the reforming operation at a pressure selected from within the range of about 100 to about 400 psig. Pressures below 350 psig are particularly advantageous as well known at this stage of the art. Liquid hourly space velocity, on the other hand, may vary considerably depending upon temperature and pressure conditions selected to optimize the severity of the operation and this may fall within the range of 0.1 up to about 10, but more usually is selected from within the range of about 1–5 LHSV.

Suitable catalysts for reforming reactions include small crystallites of platinum, platinum group metals, or platinum alloys supported on alumina base. The alumina base may be gamma, eta or other structures. The catalysts may contain platinum only or platinum with other metals such as rhenium, iridium, tin, etc. either in the bi-metallic or multi-metallic forms.

In order to more fully illustrate the present invention, without limiting the same, the following examples are provided.

EXAMPLE 1

A kinetic study of the effect of maintaining a reactor bed at near-quenching conditions in a platinum reforming process was carried out. A theoretical run was made wherein all three reactors were maintained at reforming conditions. A second run employed near-quenching conditions in the first reactor while maintaining reforming conditions in the second and third reactors. A third run maintained reforming conditions in the first and third reactors while nearly quenching the second reactor. A fourth run maintained reforming conditions in the first and second reactors while the third reactor was nearly quenched. An increase of 0.4% volume $C_5$+ reformate was observed in the second, third and fourth runs. Reaction conditions and yields of all four runs are set out in Table 1 below.

TABLE 1

| Case | Kinetic Study of the Effect of Idling Inlet Temperature in One Reactor Bed | | | |
|---|---|---|---|---|
| | Base | 1st Reactor Partially Quenched | 2nd Reactor Partially Quenched | 3rd Reactor Partially Quenched |
| Conditions | | | | |
| Reactor Pressure, psig | 250 | 250 | 250 | 250 |
| TRR (Total Recycle Ratio) | 7 | 7 | 7 | 7 |
| $C_5$+ R + O | 94.0 | 94.0 | 94.0 | 94.0 |
| LHSV | 1.00 | 1.00 | 1.00 | 1.00 |
| WHSV | 1.14 | 1.14 | 1.14 | 1.14 |
| Reactor 1 Fill, % Vol | 20 | 20 | 20 | 20 |
| 2 Fill, % Vol | 30 | 30 | 30 | 30 |
| 3 Fill, % Vol | 50 | 50 | 50 | 50 |
| Reactor 1 Inlet Temp., °F. | 910 | 675 | 950 | 963 |
| Outlet Temp., °F. | 834 | 678 | 861 | 869 |
| Reactor 2 Inlet Temp., °F. | 910 | 941 | 770 | 963 |
| Outlet Temp., °F. | 876 | 852 | 782 | 911 |
| Reactor 3 Inlet Temp., °F. | 910 | 941 | 950 | 810 |
| Outlet Temp., °F. | 890 | 895 | 895 | 829 |
| Reactor 1 Δ T, °F. | 76 | (3) | 89 | 94 |
| 2 Δ | 34 | 89 | (12) | 52 |
| 3 Δ | 20 | 46 | 55 | (19) |
| Total Δ | 130 | 132 | 132 | 127 |
| Yields | | | | |
| $C_5$+ Reformate, % vol | 76.5 | 76.9 | 76.9 | 76.9 |
| $C_4$+ | 87.1 | 87.2 | 87.2 | 87.3 |
| $C_6$+ | 63.5 | 64.2 | 64.2 | 64.1 |
| $C_5$'s, % vol | 13.0 | 12.7 | 12.7 | 12.8 |
| $C_4$'s | 10.6 | 10.3 | 10.3 | 10.4 |
| $C_1$, % wt | 1.2 | 1.2 | 1.2 | 1.2 |
| $C_2$ | 2.7 | 2.6 | 2.6 | 2.6 |
| $C_3$ | 6.4 | 6.3 | 6.3 | 6.3 |
| Benzene, % vol | 3.1 | 3.0 | 3.0 | 2.8 |
| Toluene, % vol | 8.9 | 9.0 | 9.0 | 8.9 |
| Xylene, % vol | 14.7 | 14.7 | 14.7 | 14.7 |
| $C_6$+ Aromatics, % vol | 36.6 | 36.9 | 36.9 | 36.5 |
| $H_2$ Prod., SCF/Bbl | 635 | 655 | 654 | 643 |
| $H_2$ Purity, % mole | 75.5 | 77.2 | 77.2 | 76.9 |

EXAMPLE 2

Figure 2:
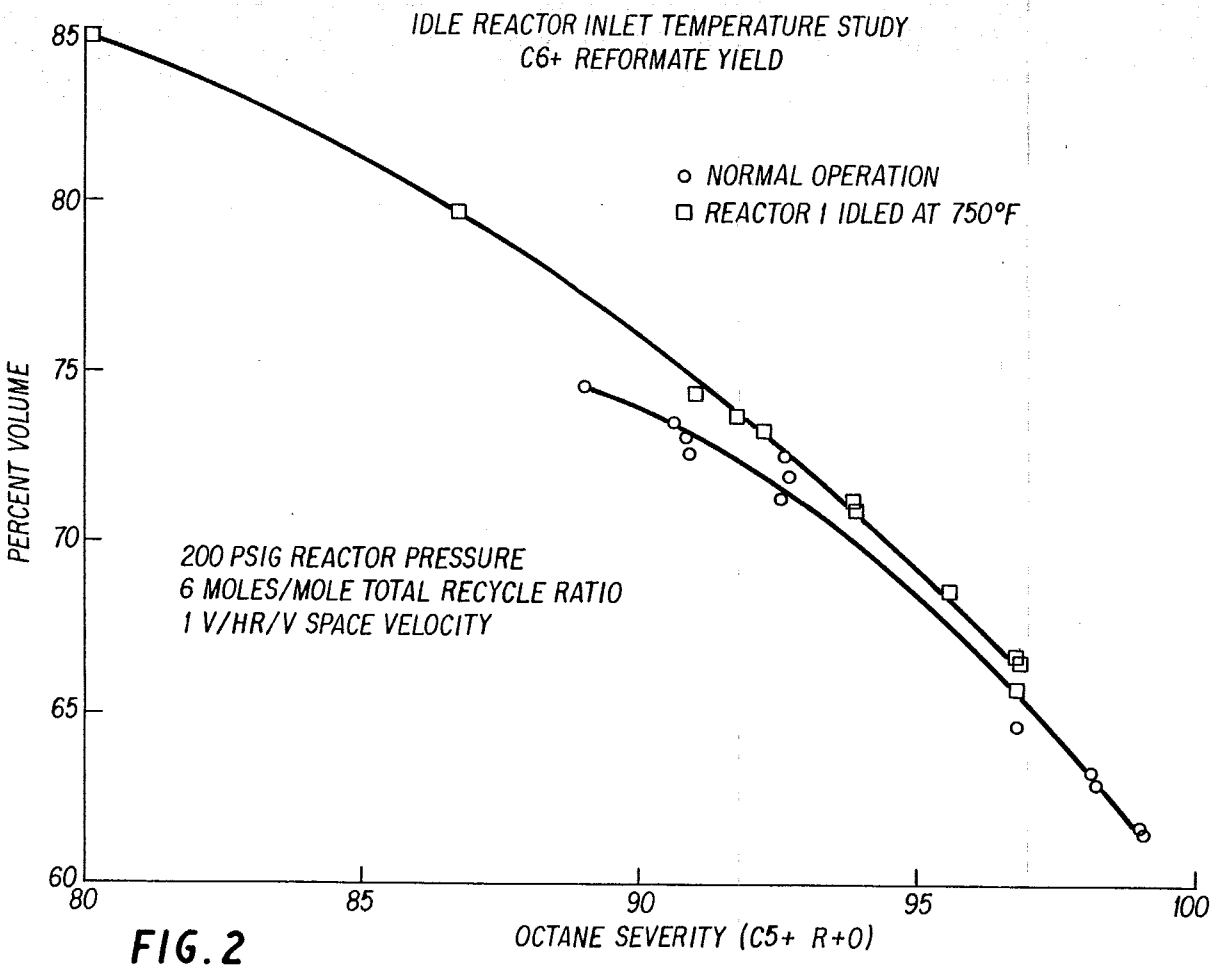
FIG. 2 depicts a comparison of the $C_6+$ reformate yield of a three reactor reforming operation wherein all three reactors are operated at reforming conditions with an operation wherein the first reactor is idled.
Figure 3:
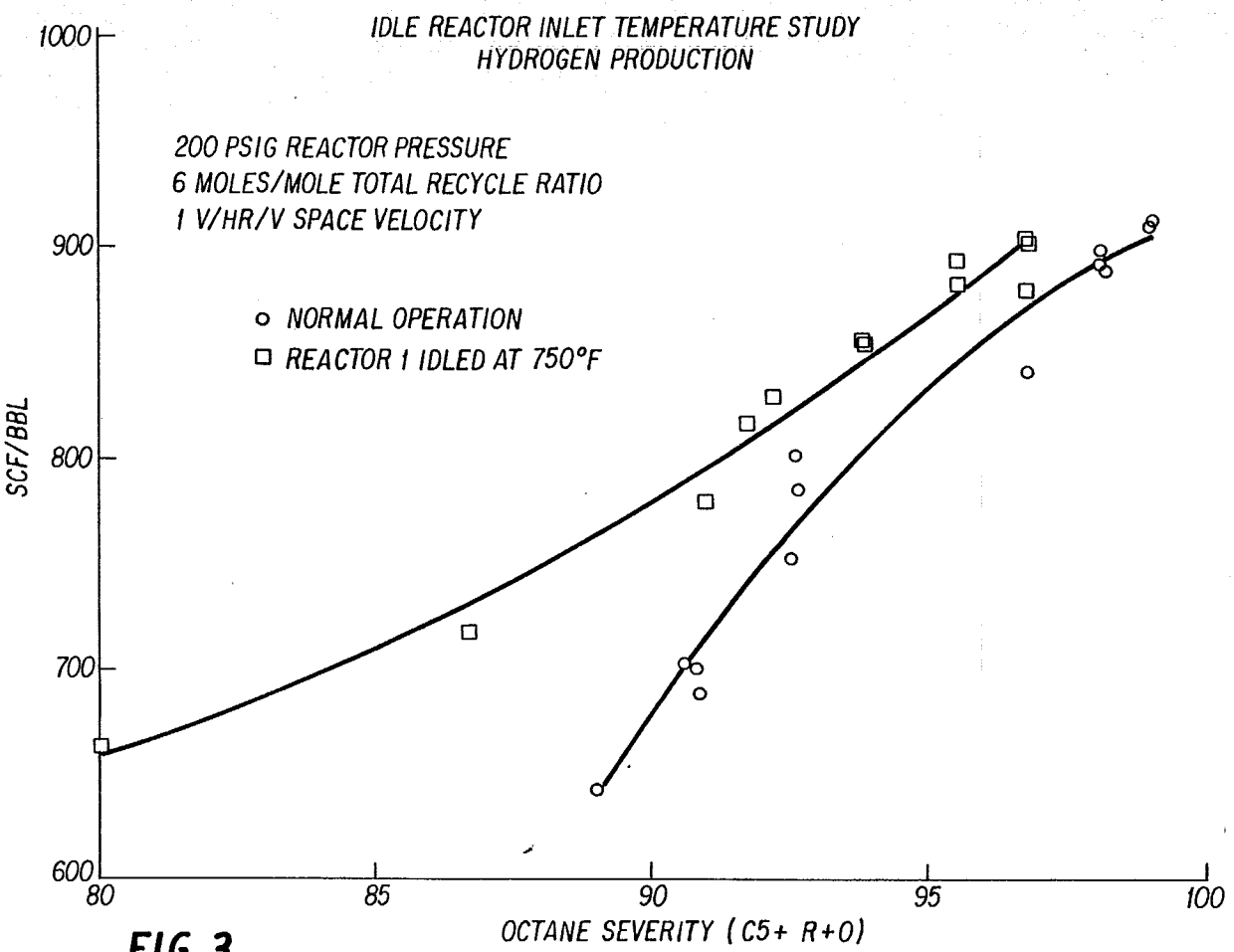
FIG. 3 depicts a comparison of the hydrogen production of a three reactor reforming operation wherein all three reactors are operated at reforming conditions with an operation wherein the first reactor is idled.
Figure 4:
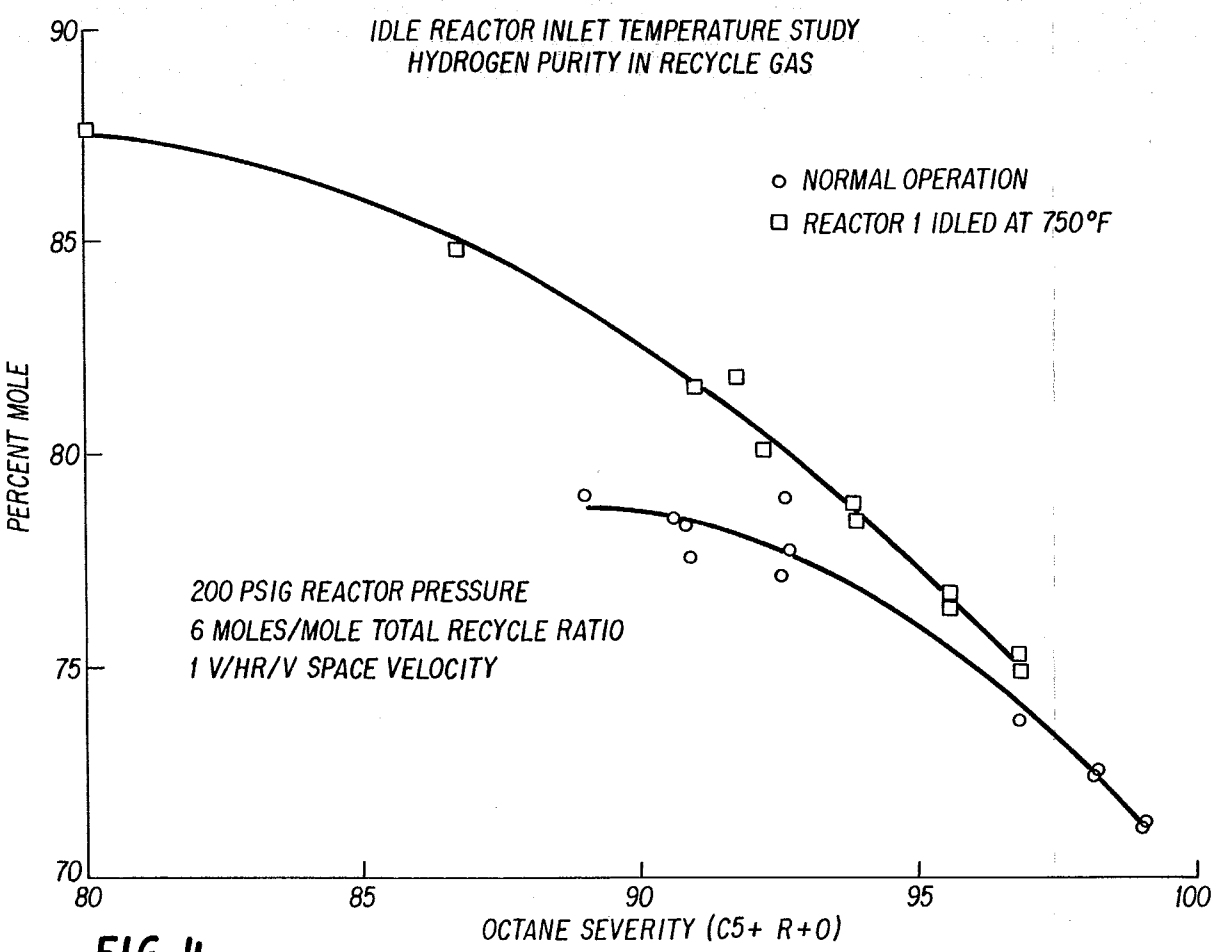
FIG. 4 depicts a comparison of the hydrogen purity in the recycle gas of a three reactor reforming operation wherein all three reactors are operated at reforming conditions with an operation wherein the first reactor is idled.

A comparison was made of reforming operations wherein all three reactors were maintained at reforming conditions and reforming operations wherein the first reactor was idled at near-quenching conditions while the second and third reactors were operated at reforming conditions. Reactor fill for both operations was 20% volume catalyst for the first reactor, 30% volume catalyst for the second reactor and 50% volume catalyst for the third reactor. The catalyst employed in both operations was platinum/rhenium bimetallic catalyst. The normal operation was carried out under the conditions set out in Table 2. Increase in $C_5$+ reformate yields, $C_6$+ reformate yields, hydrogen production, and recycle gas hydrogen purity were observed when the first reactor was idled as shown in FIGS. 1, 2, 3 and 4, respectively.

TABLE 2

| | Normal | First Reactor Partially Quenched |
|---|---|---|
| Reactor Pressure (psig) | 200 | 200 |
| TRR (Total Recycle Ratio) | 6 | 6 |
| LHSV | 1.0 | 1.0 |
| Reactor 1 Catalyst Fill (% volume) | 20 | 20 |
| Reactor 2 Catalyst Fill (% volume) | 30 | 30 |
| Reactor 3 Catalyst Fill (% volume) | 50 | 50 |
| Reactor 1 Inlet Temp., °F. | 898 | 750 |
| Reactor 1 Outlet Temp., °F. | 808 | 716 |
| Reactor 2 Inlet Temp., °F. | 898 | 920 |
| Reactor 2 Outlet Temp., °F. | 859 | 850 |

TABLE 2-continued

| | Normal | First Reactor Partially Quenched |
|---|---|---|
| Reactor 3 Inlet Temp., °F. | 898 | 920 |
| Reactor 3 Outlet Temp., °F. | 867 | 882 |
| Reactor 1 T, °F. | 90 | 34 |
| Reactor 2 | 39 | 70 |
| Reactor 3 | 31 | 38 |

What is claimed is:

1. In a method for reforming naphtha boiling range hydrocarbon charge stocks with platinum group metal-containing reforming catalysts employing a plurality of catalyst bed reactors, the improvement whereby reformer $C_5$+ yield selectivity is enhanced which comprises operating at least one reactor at near-quenching conditions comprising inlet temperatures ranging from about 316° to 427° C. (600° to 800° F.) while operating at least one reactor under yield-selective reforming conditions conditions comprising inlet temperatures ranging from about 454° to 549° C. (850° to 1020° F.).

2. The method of claim 1 wherein said reforming is carried out in the presence of a first, second and third catalyst bed.

3. The method of claim 2 wherein said first catalyst bed is maintained at near-quenching conditions while said second and third catalyst beds are maintained at yield-selective reforming conditions.

4. The method of claim 2 wherein said second catalyst bed is maintained at near-quenching conditions while said first and third catalyst beds are maintained at yield-selective reforming conditions.

5. The method of claim 2 wherein said third catalyst bed is maintained at near-quenching conditions while said first and second catalyst beds are maintained at yield-selective reforming conditions.

6. The method of claim 2 wherein said first catalyst bed is maintained at an inlet temperature ranging from about 316° to 427° C. (600° to 800° F.), said second catalyst bed is maintained at an inlet temperature ranging from about 454° to 549° C. (850° to 1020° F.) and said third catalyst bed is maintained at an inlet temperature ranging from about 454° to 549° C. (850° to 1020° F.).

7. The method of claim 2 wherein said first catalyst bed is maintained at an inlet temperature of about 454° to 549° C. (850° to 1020° F.) said second catalyst bed is maintained at an inlet temperature ranging from about 343° to 427° C. (650° to 800° F.) and said third catalyst bed is maintained at an inlet temperature ranging from about 454° to 549° C. (850° to 1020° F.).

8. The method of claim 2 wherein said first catalyst bed is maintained at an inlet temperature ranging from about 454° to 549° C. (850° to 1020° F.), said second catalyst bed is maintained at an inlet temperature ranging from about 454° to 549° C. (850° to 1020° F.) and said third catalyst bed is maintained at an inlet temperature ranging from about 371° to 427° C. (700° to 800° F.).

9. The method of claim 1 wherein said reforming catalyst comprises a platinum type metal selected from the group consisting of platinum, palladium, and rhodium.

10. The method of claim 9 wherein said platinum type metal is supported on alumina.

11. The method of claim 10 wherein said reforming catalyst is a platinum-alumina catalyst.

12. The method of claim 2 wherein the first and second catalyst beds contain approximately equal volumes of catalyst while the third catalyst bed contains at least the sum of the volumes of the first and second catalyst beds.

13. The method of claim 9 wherein the first catalyst bed contains about 20% of the total catalyst volume, the second catalyst bed contains about 30% of the total catalyst volume and the third catalyst bed contains about 50% of the total catalyst volume.

14. The method of claim 9 wherein said reforming catalyst comprises rhenium.

* * * * *